US009327154B2

(12) United States Patent
Lin

(10) Patent No.: US 9,327,154 B2
(45) Date of Patent: May 3, 2016

(54) EXERCISE EQUIPMENT FOR PACE TRAINING

(71) Applicant: Chieh-Yi Lin, New Taipei (TW)

(72) Inventor: Chieh-Yi Lin, New Taipei (TW)

(73) Assignee: Unique Point Industrial Co. Ltd., New Taipei ( * ) Notice: Subject to any disclaimer, the term of this patent is extended or adjusted under 35 U.S.C. 154(b) by 42 days.

(21) Appl. No.: 14/183,377

(22) Filed: Feb. 18, 2014

(65) Prior Publication Data

US 2015/0231434 A1 Aug. 20, 2015

(51) Int. Cl.
*A63B 5/22* (2006.01)

(52) U.S. Cl.
CPC ..... *A63B 5/22* (2013.01); *A63B 2210/50* (2013.01); *A63B 2225/09* (2013.01)

(58) Field of Classification Search
CPC ... A63H 33/06; A63H 33/062; A63H 33/067; A63H 33/08; A63H 33/082; A63H 33/086; A63H 33/088; A63H 33/101
See application file for complete search history.

(56) References Cited

U.S. PATENT DOCUMENTS 3,200,464 A * 8/1965 Cousins ..... 24/593.1
5,947,787 A * 9/1999 Cyrus ..... A63H 18/00 446/105

* cited by examiner

*Primary Examiner* — Loan H Thanh
*Assistant Examiner* — Rae Fischer
(74) *Attorney, Agent, or Firm* — Che-Yang Chen; Law Offices of Scott Warmuth

(57) ABSTRACT

An exercise equipment for pace training may include a connecting unit and an extension rod. The connecting unit is square has four side surfaces and a top surface, and a connecting opening is formed on each of the side surfaces, and the top surface has four restricting openings connecting with the connecting opening. The connecting portion is formed at one end of the extension rod and the connecting portion has a resilient piece with a reverse hook, and the connecting portion is configured to plug into the connecting opening of the connecting unit, while the resilient piece is configured to engage with the restricting opening to connect the connecting unit and the extension rod.

2 Claims, 8 Drawing Sheets

EXERCISE EQUIPMENT FOR PACE TRAINING

FIELD OF THE INVENTION

This invention relates to an exercise equipment, and more particularly to an exercise equipment for pace training.

BACKGROUND OF THE INVENTION

In general, sports like long jump, pole vault, hurdles or the like, footsteps of the athletes have to be paced, and the athletes have to use a predetermined number of footsteps to reach a predetermined position to achieve better results, so when during practice, the athletes usually use pace training equipment to pace themselves. A conventional pace device may includes a main belt and a plurality of connecting partition boards, and two through holes are disposed at both ends of each side of the partition boards. The main belt is configured to pass through the through holes of the partition boards, so the partition boards can be disposed spacedly in a parallel manner and the athletes can use it to practice the footsteps. However, the conventional pace training device may have some shortcomings as following: (i) the partition boards and the main belt are connected merely through the through holes, so the partition boards are vulnerable to external influences that may cause displacement thereof, for example, when the user steps on the partition boards, the board may be displaced and have to be adjusted; (ii) the pace training device can only be linearly arranged; and (c) although the space between the partition boards can be adjusted, the adjustment can only be done visually by a person, so it is not reproducible and not precise. Therefore, there remains a need for a new and improved pace training device to overcome the problems stated above.

SUMMARY OF THE INVENTION

The present invention provides an exercise equipment for pace training that may include a connecting unit and an extension rod. In one embodiment, the connecting unit is square has four side surfaces and a top surface, and a connecting opening is formed on each of the side surfaces. The top surface of the connecting unit has four restricting openings connecting with the connecting opening. A connecting portion is formed at one end of the extension rod and the connecting portion has a resilient piece with a reverse hook. The connecting portion of the extension rod is configured to plug into the connecting opening of the connecting unit, and the resilient piece is configured to engage with the restricting opening to connect the connecting unit and the extension rod.

In another embodiment, the extension rod has a plurality of lateral connecting points and a second restricting opening is connecting and communicating with the connecting point. In one embodiment, the connecting portion of the extension rod can plug into the connecting point, and the resilient piece of another extension rod can engage with the second restricting opening to connect multiple extension rods. Both sides of the extension rod have a plurality of lateral connecting points, so that the extension rod can plug into the connecting point through the connecting portion while the resilient piece is engaging with the second restricting opening with the reverse hook. The space between the extension rod and the connecting unit can be easily adjustable because of the lateral connecting points and the pace training equipment can be more easily and flexibly to use.

In a further embodiment, the exercise equipment for pace training may further include a connecting belt. Both ends of the connecting belt have a connector that has a connecting piece with a reverse hook, and a plugging hole is formed on both sides near the connecting portion of the extension rod and the plugging hole has a conjugating point that is connecting and communicating therewith. The connector is configured to plug into the plugging hole of the extension rod while the connecting piece is engaging with the conjugating point with the reverse hook, so the connecting belt can be connected between two parallel extension rods to enhance the structural strength of the connection of the extension rod and the connecting unit. Furthermore, the space between two parallel extension rods can be adjusted through the connecting belt.

The main object of the present invention is that the connecting portion of the extension rod can plug into the connecting opening of the connecting unit while the resilient piece is engaging with the restricting opening to quickly assemble/disassemble the connecting unit and the extension rod. Furthermore, the connecting openings are disposed at four directions of the connecting unit to generate more patterns when connecting with the extension rod.

The second object of the present invention is that both sides of the extension rod have a plurality of lateral connecting points, so that the extension rod can plug into the connecting point through the connecting portion while the resilient piece is engaging with the second restricting opening with the reverse hook. The space between the extension rod and the connecting unit can be easily adjustable because of the lateral connecting points and the pace training equipment can be more easily and flexibly to use.

The third object of the present invention is that the connector is configured to plug into the plugging hole of the extension rod while the connecting piece is engaging with the conjugating point with the reverse hook, so the connecting belt can be connected between two parallel extension rods to enhance the structural strength of the connection of the extension rod and the connecting unit. Furthermore, the space between two parallel extension rods can be adjusted through the connecting belt.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
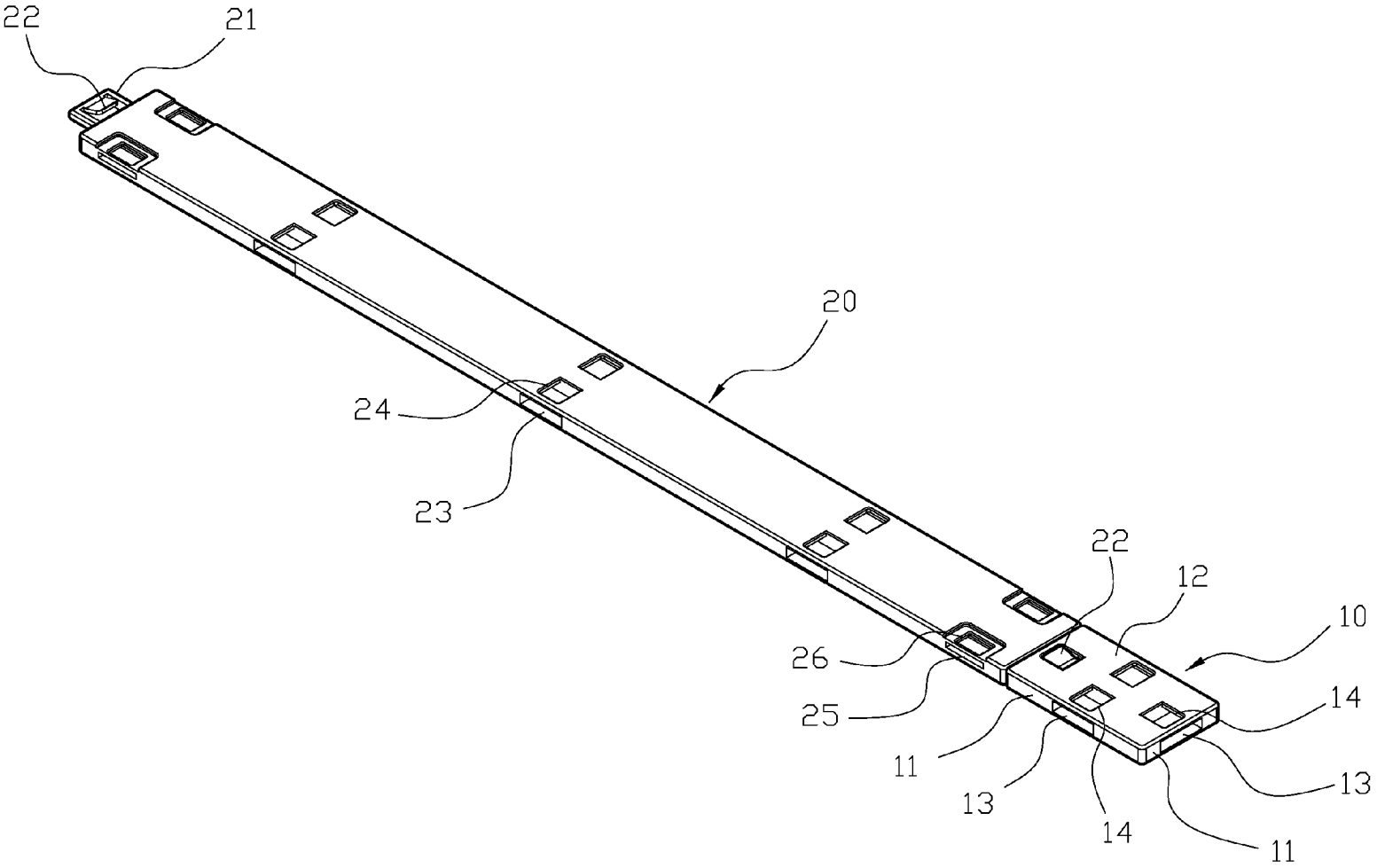
FIG. 1 illustrates a three-dimensional view of the present invention.
Figure 2:
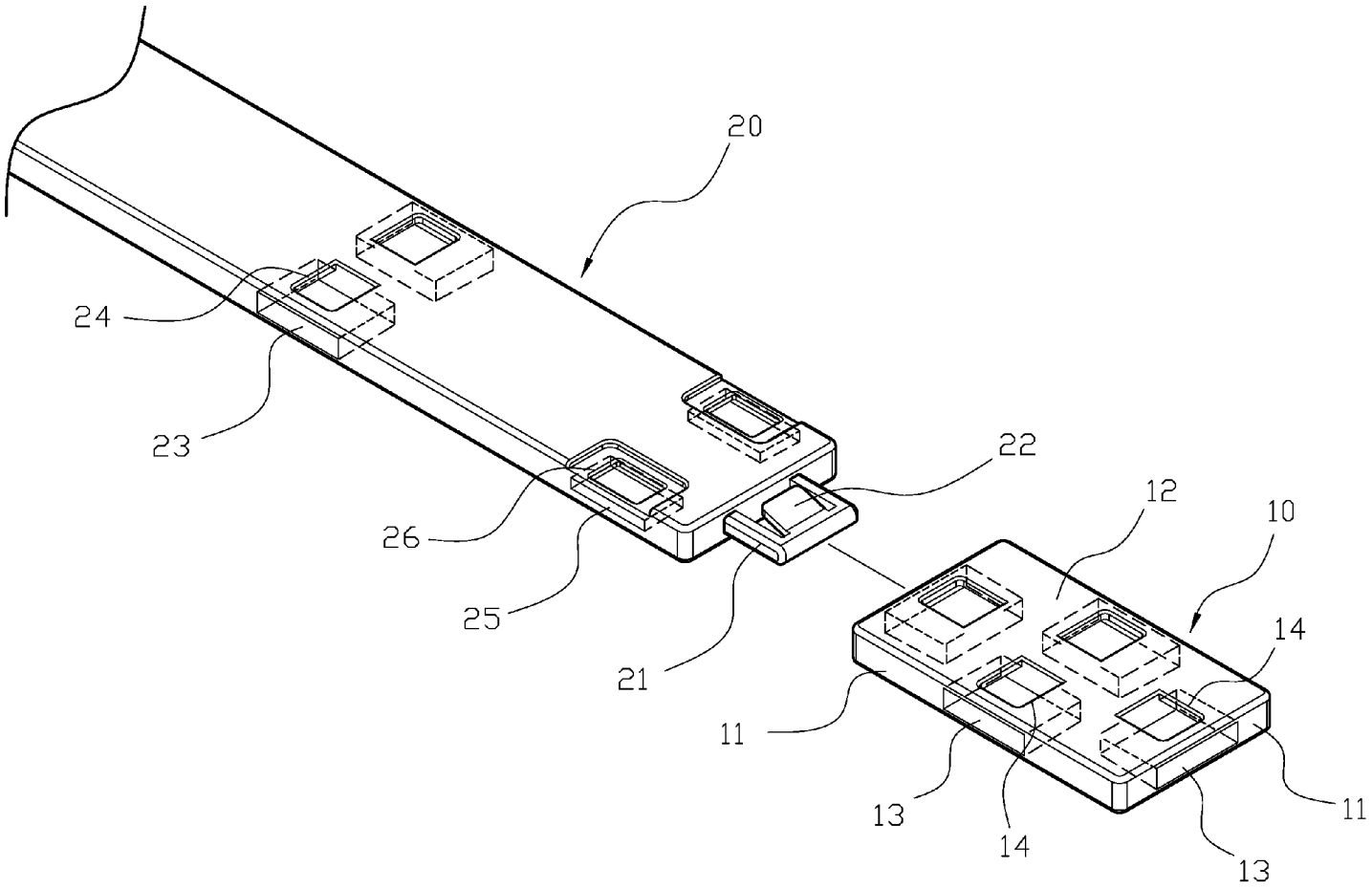
FIG. 2 illustrates a three-dimensional exploded view of the present invention.
Figure 3:
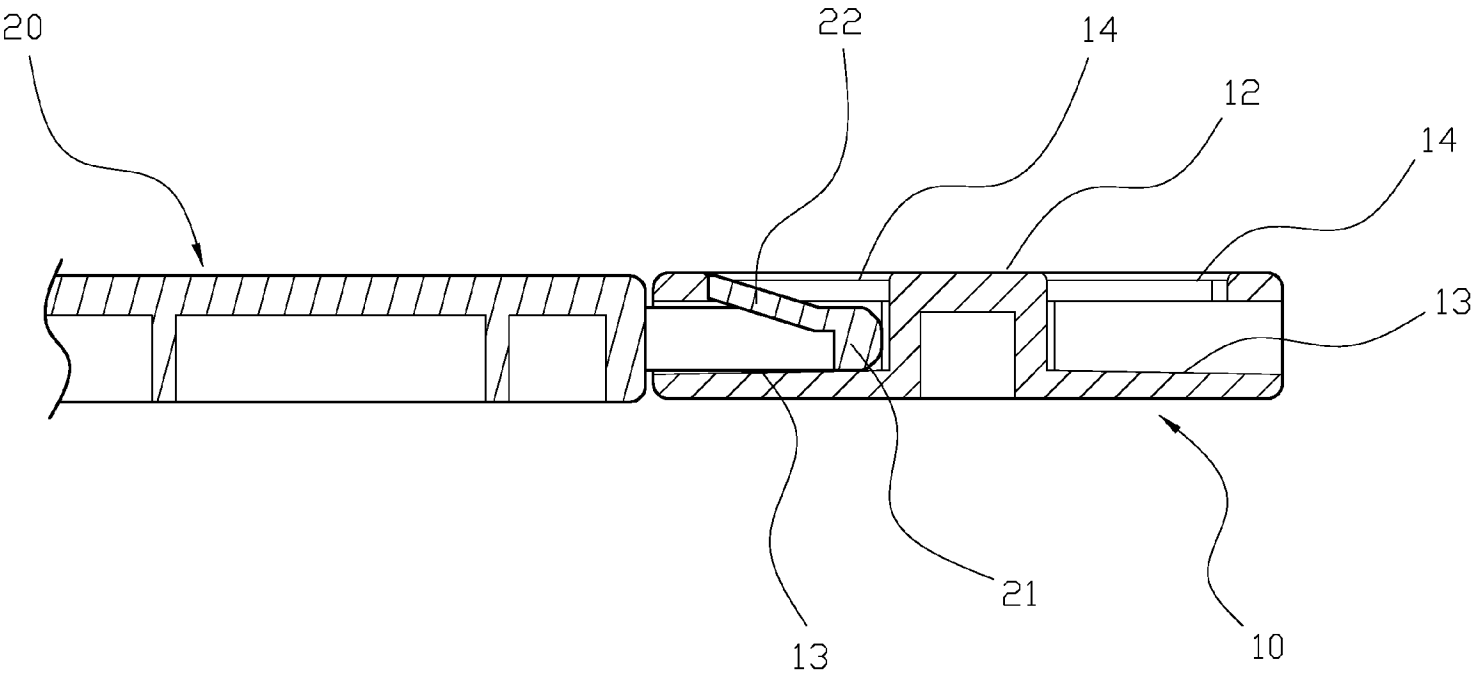
FIG. 3 illustrates a sectional view of the present invention.
Figure 4:
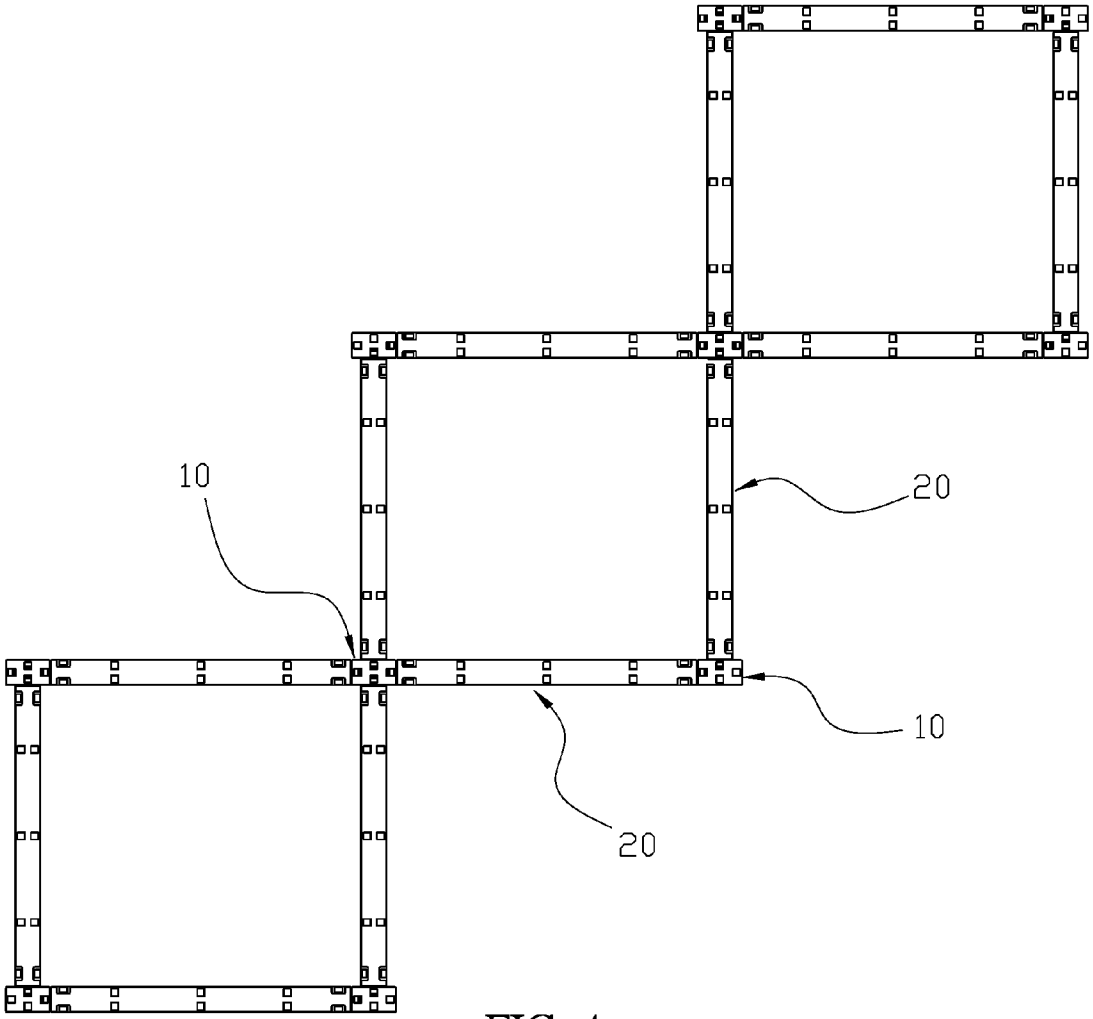
FIG. 4 illustrates a schematic view of the pace training equipment in use.

In order to further understand the goal, characteristics and effect of the present invention, a number of embodiments along with the drawings are illustrated as following:

Referring to FIGS. 1 to 3, an exercise equipment for pace training may include a connecting unit (10) and an extension rod (20). In one embodiment, the connecting unit (10) is square has four side surfaces (11) and a top surface (12), and a connecting opening (13) is formed on each of the side surfaces (11). The top surface (12) of the connecting unit (10) has four restricting openings (14) connecting with the connecting opening (13). A connecting portion (21) is formed at one end of the extension rod (20) and the connecting portion (21) has a resilient piece (22) with a reverse hook. The connecting portion (21) of the extension rod (20) is configured to plug into the connecting opening (13) of the connecting unit (10), and the resilient piece (22) is configured to engage with the restricting opening (14) to connect the connecting unit (10) and the extension rod (20).

Referring to FIGS. 1 to 4, each of the side surfaces (11) of the connecting unit (10) has a connecting opening (13), so the connecting portion (21) of the extension rod (20) can plug into the connecting opening (13). Meanwhile, the resilient piece (22) is configured to engage with the restricting opening (14) of the connecting unit (10) with the reverse hook to quickly connect the connecting unit (10) and the extension rod (20). Furthermore, the pattern after the connection of the connecting unit (10) and the extension rod (20) can be changed through the four connecting openings (13) of the connecting unit (10). The pattern can be linear, square, rectangular, Z-shaped, and diamond-shaped, etc. to enable the user to do pace training. The training equipment is advantageous because the connecting portion (21) of the extension rod (20) can plug into the connecting opening (13) of the connecting unit (10) while the resilient piece (22) is engaging with the restricting opening (14) to quickly assemble/disassemble the connecting unit (10) and the extension rod (20). Furthermore, the connecting openings (13) are disposed at four directions of the connecting unit (10) to generate more patterns when connecting with the extension rod (20).

Figure 5:
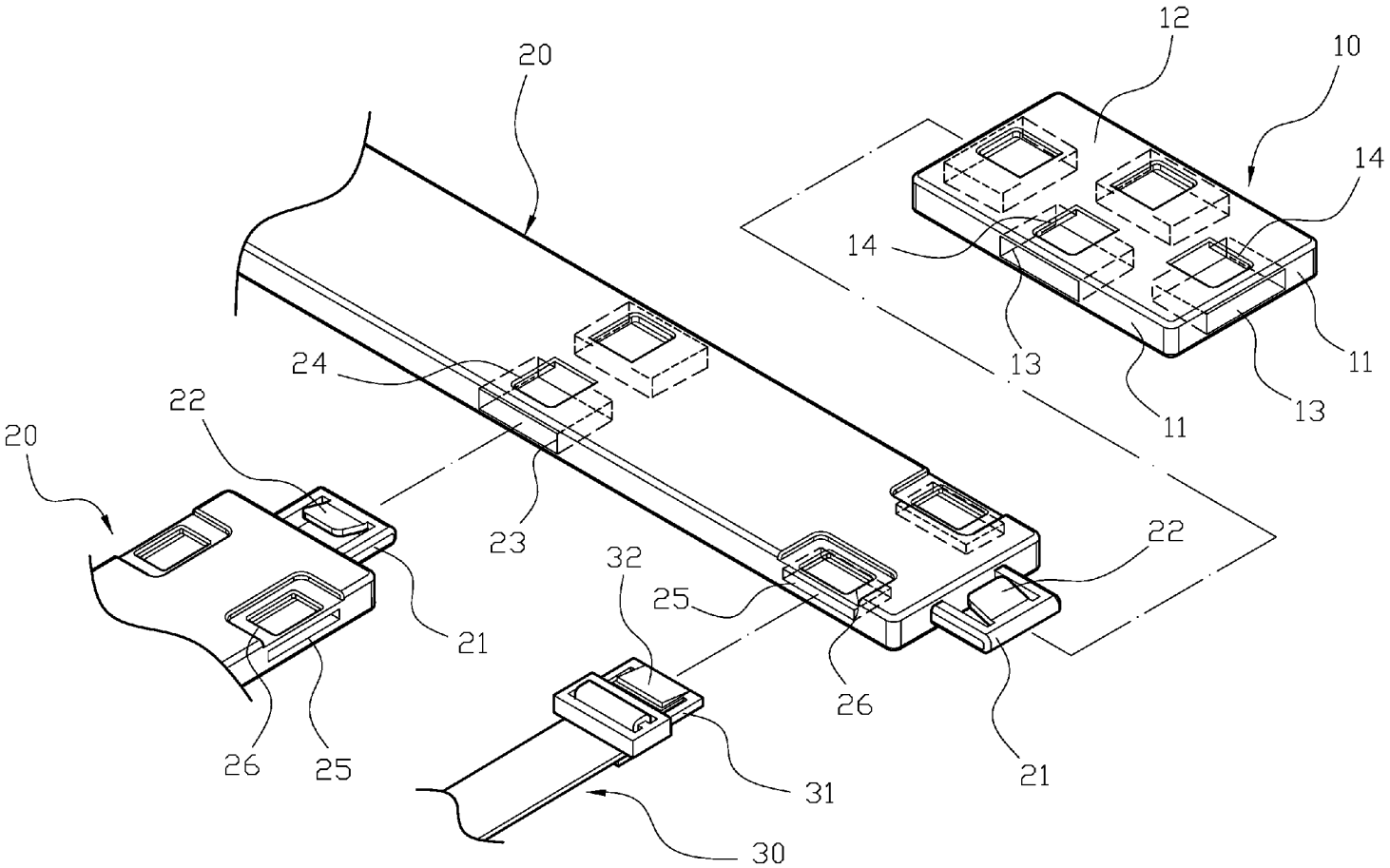
FIG. 5 illustrates a three-dimensional exploded view of another embodiment in the present invention.
Figure 6:
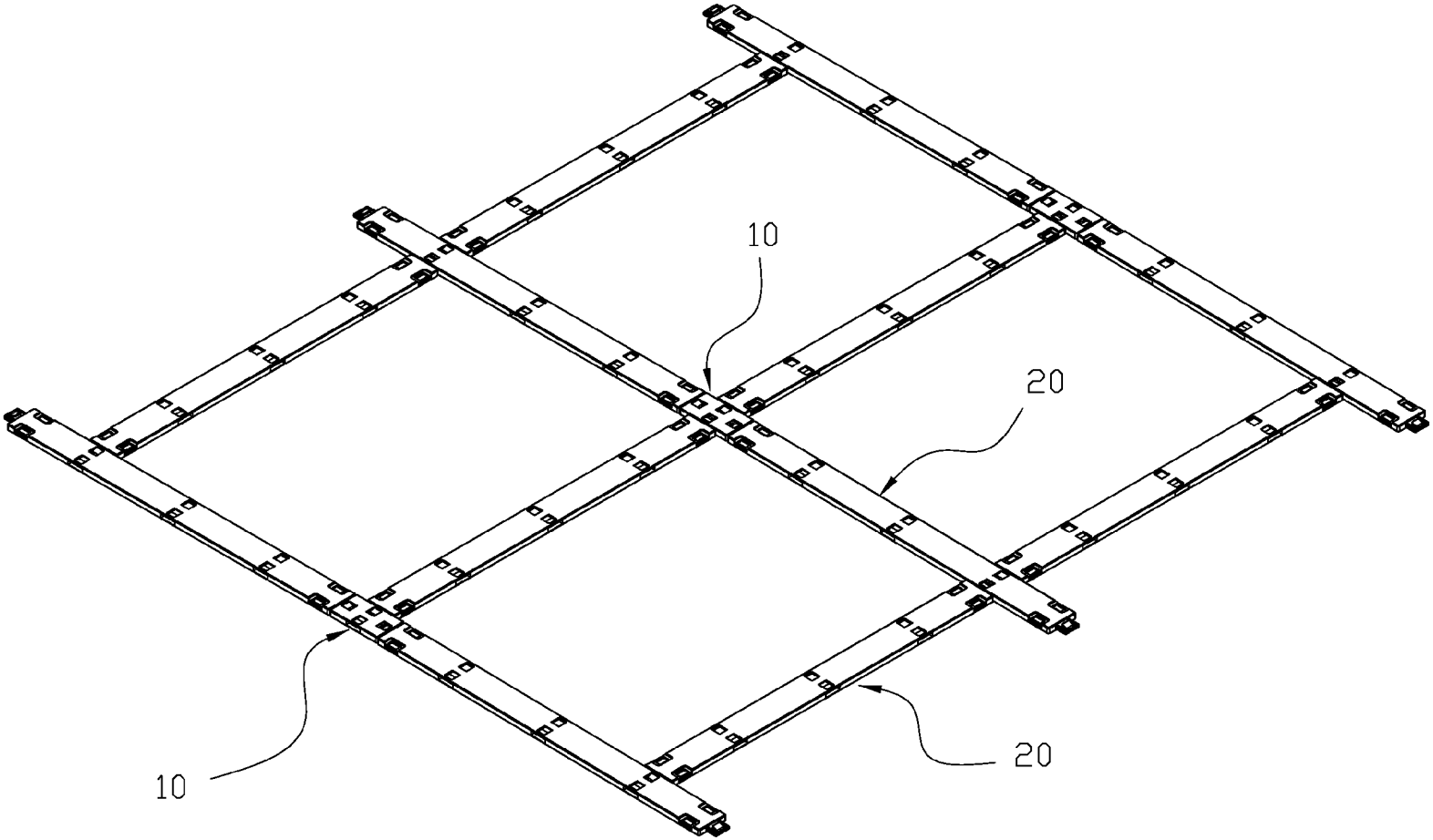
FIG. 6 illustrates a schematic view of another embodiment when in use in the present invention.

Referring to FIGS. 5 and 6 for another embodiment, the extension rod (20) has a plurality of lateral connecting points (23) and a second restricting opening (24) is connecting and communicating with the connecting point (23). In one embodiment, the connecting portion (21) of the extension rod (20) can plug into the connecting point (23), and the resilient piece (22) of another extension rod (20) can engage with the second restricting opening (24) to connect multiple extension rods (20). In summary, both sides of the extension rod (20) have a plurality of lateral connecting points (23), so that the extension rod (20) can plug into the connecting point (23) through the connecting portion (21) while the resilient piece (22) is engaging with the second restricting opening (24) with the reverse hook. As can be seen in FIGS. 5 and 6, the space between the extension rod (20) and the connecting unit (10) can be easily adjustable because of the lateral connecting points (23) and the pace training equipment can be more easily and flexibly to use.

Figure 7:
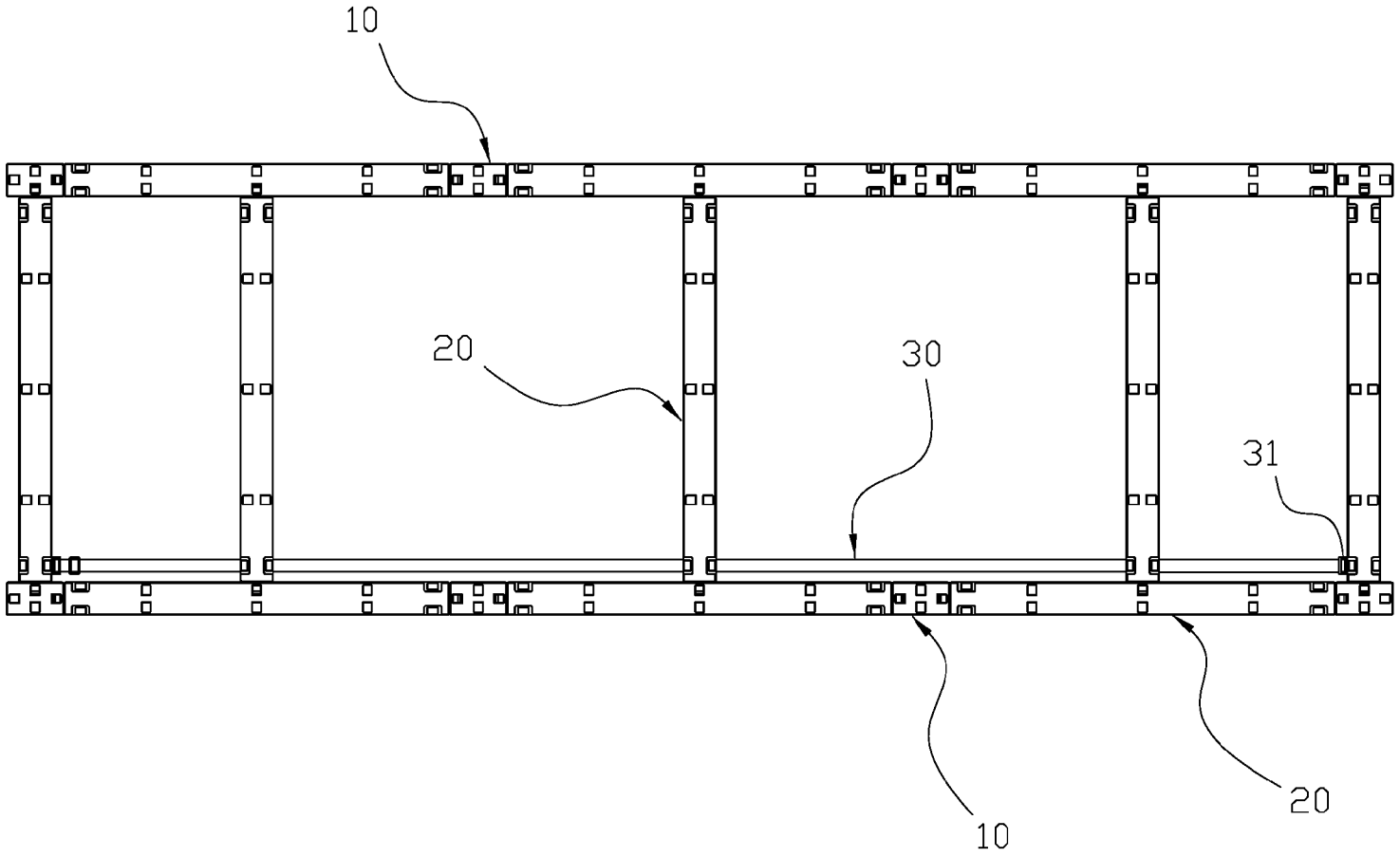
FIG. 7 illustrates a schematic view of a further embodiment when in use in the present invention.
Figure 8:
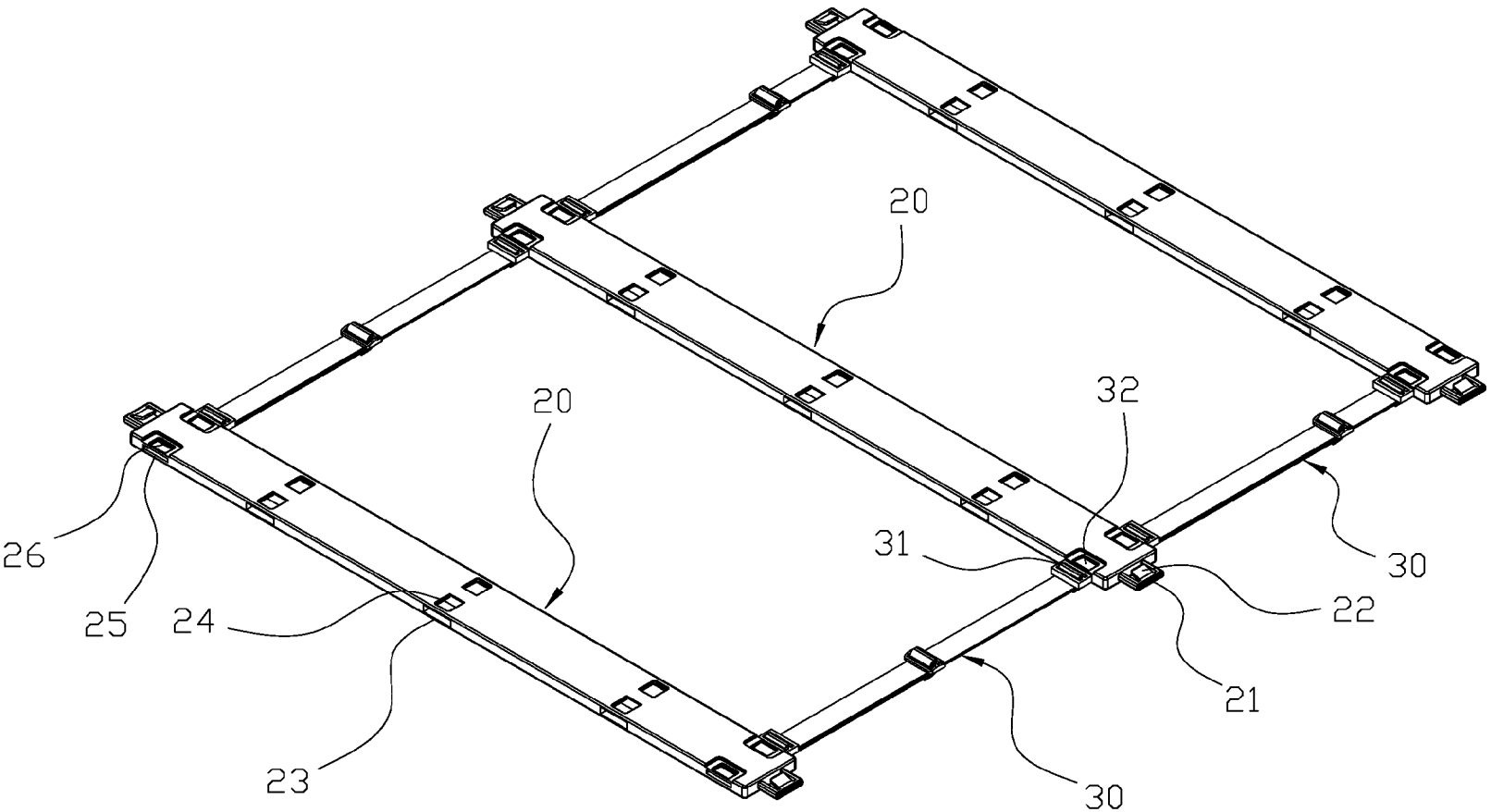
FIG. 8 illustrates another schematic view of the further embodiment when in use in the present invention.

Referring to FIGS. 5, 7 and 8 for a further embodiment, an exercise equipment for pace training may include a connecting unit (10), an extension rod (20) and a connecting belt (30). Both ends of the connecting belt (30) have a connector (31) that has a connecting piece (32) with a reverse hook, and a plugging hole (25) is formed on both sides near the connecting portion (21) of the extension rod (20), and the plugging hole (25) has a conjugating point (26) that is connecting and communicating therewith. The connector (31) is configured to plug into the plugging hole (25) of the extension rod (20) while the connecting piece (32) is engaging with the conjugating point (26) with the reverse hook, so the connecting belt (30) can be connected between two parallel extension rods (20) to enhance the structural strength of the connection of the extension rod (20) and the connecting unit (10). Furthermore, the space between two parallel extension rods (20) can be adjusted through the connecting belt (30).

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. An exercise equipment for pace training comprising:

a connecting unit having four side surfaces and a top surface and comprising a connecting opening formed on each of the side surfaces, and four restricting openings formed on the top surface and continuous with the connecting opening;

an extension rod having two side surfaces, two ends and a top surface and further comprising:

a plugging hole formed in each of the side surfaces of the extension rod near one of the ends;

a conjugating point formed in the top surface of the extension rod; and a connecting portion, comprising a resilient reverse hook, formed at one end of the extension rod and configured to plug in to one of the connecting openings to engage with one of the restricting openings so as to connect the connecting unit and the extension rod; and a connecting belt having two ends, each end having a connector with a connecting piece in the form of a reverse hook and configured to plug in to one of the plugging holes to engage with one of the conjugating points so as to connect the connecting belt and the extension rod, wherein the connecting belt is configured to adjust a distance between the extension rods.

2. The exercise equipment for pace training of claim 1, further comprising:

a second extension rod having two side surfaces, two ends and a top surface and comprising:

a plugging hole formed in each of the side surfaces of the extension rod near one of the ends;

a conjugating point formed in the top surface of the extension rod;

a connecting portion, comprising a resilient reverse hook, formed at one end of the extension rod and configured to plug in to one of the connecting openings to engage with one of the restricting openings so as to connect the connecting unit and the extension rod;

a plurality of lateral connecting points formed on the sides of the side surfaces of the extension rod; and a plurality of restricting openings, each formed on the top surface of the extension rod and continuous with one of the lateral connecting points wherein the connecting portion of the first extension rod is configured to plug in to one of the connecting points of the second extension rod to engage with the restricting opening associated with that connecting point so as to connect the second extension rod to the first extension rod.

* * * * *